US007444694B2

(12) United States Patent
Brewin et al.

(10) Patent No.: US 7,444,694 B2
(45) Date of Patent: Nov. 4, 2008

(54) INFANT SLEEP POSITIONER

(75) Inventors: Joseph F. Brewin, Franklin, MA (US); Antonio S. Fernandes, Fall River, MA (US); Bryan R. Hotaling, Acton, MA (US); Lawrence J. Salvo, Stow, MA (US)

(73) Assignee: The First Years Inc., Avon, MA (US)

( * ) Notice: Subject to any disclaimer, the term of this patent is extended or adjusted under 35 U.S.C. 154(b) by 0 days.

(21) Appl. No.: 11/246,968

(22) Filed: Oct. 7, 2005

(65) Prior Publication Data

US 2006/0026766 A1 Feb. 9, 2006

Related U.S. Application Data

(63) Continuation of application No. 10/459,128, filed on Jun. 10, 2003, now Pat. No. 6,954,955.

(51) Int. Cl.
*A47D 7/04* (2006.01)

(52) U.S. Cl. ..... 5/94; 5/95; 5/655

(58) Field of Classification Search ..... 5/655, 5/99.1, 94–95, 424, 503.1
See application file for complete search history.

(56) References Cited

U.S. PATENT DOCUMENTS

| | | | |
|---|---|---|---|
| 279,134 | A | 6/1883 | Comins |
| 385,633 | A | 7/1888 | Kelly et al. |
| 469,253 | A | 2/1892 | Johnston |
| 571,681 | A | 11/1896 | Newell |
| 2,281,629 | A | 5/1942 | Snow |
| 2,401,605 | A | 6/1946 | Boren |
| 2,475,775 | A | 7/1949 | Boren |
| 2,570,361 | A | 10/1951 | Mejia |
| 2,602,171 | A | 7/1952 | Good |
| 2,649,594 | A | 8/1953 | Herz |
| 2,709,478 | A | 5/1955 | Golding |
| 3,003,164 | A | 10/1961 | Calvelage |
| 3,018,492 | A | 1/1962 | Rosen |
| 3,096,917 | A | 7/1963 | Gudiksen |
| 3,145,395 | A | 8/1964 | Rosman |
| 3,269,621 | A | 8/1966 | Dishart |
| 3,336,608 | A | 8/1967 | Lemer |
| 3,383,718 | A | 5/1968 | Spencer |
| 3,466,678 | A | 9/1969 | Glaser |
| 3,492,680 | A | 2/1970 | Coolidge |
| 3,513,489 | A | 5/1970 | Miller et al. |

(Continued)

FOREIGN PATENT DOCUMENTS

| | | | |
|---|---|---|---|
| GB | 2280366 | A | 2/1995 |

*Primary Examiner*—Fredrick Conley
(74) *Attorney, Agent, or Firm*—Michael Best & Friedrich LLP

(57) ABSTRACT

A device for stabilizing the position of an infant while sleeping features a shell assembly including a base panel having two longitudinal sides and two lateral sides, an end wall extending generally upwardly from one of the lateral sides, two side walls extending generally upwardly from the longitudinal sides, a shell cover comprising an outer surface and conforming generally to the shell assembly, and a removable positioner insert disposed atop the base panel and comprising left and right nacelles attached to an insert base and separated by a distance selected to accommodate the width of an infant placed between the nacelles, to inhibit lateral motion of the infant while sleeping.

20 Claims, 4 Drawing Sheets

U.S. PATENT DOCUMENTS 3,708,808 A 1/1973 Irby
3,729,752 A 5/1973 Huggins
3,763,506 A 10/1973 Szego
3,931,652 A 1/1976 Navarra
4,003,098 A 1/1977 Fink
D259,458 S 6/1981 Fuller et al.
4,366,587 A * 1/1983 Takada ..... 5/94
4,441,221 A 4/1984 Enste et al.
4,471,767 A 9/1984 Guimond
4,499,619 A 2/1985 Kassai
4,577,355 A 3/1986 Kassai
4,583,253 A 4/1986 Hall
4,602,395 A 7/1986 Kassai
4,616,371 A 10/1986 Kassai
4,635,305 A 1/1987 Wyss
4,670,923 A 6/1987 Gabriel et al.
4,698,862 A 10/1987 Mairs
4,712,258 A 12/1987 Eves
4,750,223 A 6/1988 D'Arcy et al.
4,773,702 A 9/1988 Takahashi
4,819,284 A 4/1989 Brown
4,819,285 A 4/1989 Fetters
4,873,734 A 10/1989 Pollard
4,932,086 A 6/1990 Bergkvist
4,999,863 A 3/1991 Kane
5,103,514 A 4/1992 Leach
5,115,524 A 5/1992 Antosko
5,161,270 A 11/1992 Najmabadi
5,172,435 A 12/1992 Griffin et al.
5,216,772 A 6/1993 Clute
5,233,710 A 8/1993 Bernard
D342,405 S 12/1993 Hazel
5,333,769 A 8/1994 Skroski
5,359,739 A 11/1994 Rains et al.
5,367,730 A 11/1994 Sher
5,377,368 A 1/1995 Cheng
5,379,469 A 1/1995 Millis et al.
5,383,711 A 1/1995 Houghteling
5,409,411 A 4/1995 Schreiber
D359,869 S 7/1995 Oren
5,430,899 A 7/1995 Chisholm
D366,368 S 1/1996 McCarthy
5,528,785 A 6/1996 Petrus
5,551,108 A 9/1996 Butler, III
5,562,330 A 10/1996 Jane Cabagnero
5,604,941 A 2/1997 Roman
5,611,414 A 3/1997 Walker
5,675,853 A 10/1997 Linge
5,708,994 A 1/1998 Chandran
5,713,090 A 2/1998 Rodgers
D391,780 S 3/1998 Onishi
5,730,490 A * 3/1998 Mortenson ..... 297/184.13
D397,882 S 9/1998 Wu
5,800,368 A 9/1998 Klingemann et al.
5,802,635 A 9/1998 Chen
5,806,924 A * 9/1998 Gonas ..... 297/216.11
5,813,558 A 9/1998 Burke
5,819,341 A 10/1998 Simantob et al.
5,826,287 A 10/1998 Tandrup
5,884,348 A 3/1999 Onishi et al.
5,916,089 A * 6/1999 Ive ..... 5/655
5,937,461 A 8/1999 Dombrowski et al.
5,987,665 A 11/1999 Simantob et al.
6,023,802 A 2/2000 King
6,112,347 A 9/2000 Tharalson et al.
6,155,970 A 12/2000 Dykes et al.
6,205,600 B1 3/2001 Sedlack
6,370,715 B1 4/2002 Morton
6,390,260 B1 5/2002 Roegner
6,549,140 B1 4/2003 Koessler
6,651,275 B1 11/2003 Rummell
6,654,275 B2 11/2003 Forbes
6,704,949 B2 3/2004 Waldman et al.
6,823,547 B1 11/2004 Harding et al.
6,907,627 B2 6/2005 Waldman et al.
6,954,955 B2 * 10/2005 Brewin et al. ..... 5/655

* cited by examiner

INFANT SLEEP POSITIONER

CROSS-REFERENCE TO RELATED APPLICATION

This application is a continuation of U.S. patent application Ser. No. 10/459,128, filed on Jun. 10, 2003 now U.S. Pat. No. 6,954,955, the entire contents of which is incorporated herein by reference.

TECHNICAL FIELD

This invention relates to a sleep positioner for holding an infant while sleeping.

BACKGROUND

Many parents elect to place their infants on adult beds for napping or sleeping. Research has demonstrated that infants who sleep with their parents (sometimes referred to as "co-sleeping") breastfeed more and receive more protective care and attention during the night, which can be beneficial to the developing child. When co-sleeping, however, parents must take special precautions to ensure the safety of the child such as to avoid possible entrapment of the infant between the bed and the wall or between the bed and headboard, and to limit the infant's contact with soft bedding materials.

A device is desired that can facilitate the advantages attendant to co-sleeping while reducing any associated risks and enhancing child comfort.

SUMMARY

According to one aspect, a device for stabilizing the position of an infant features a shell assembly including a base panel having two longitudinal sides and two lateral sides, an end wall extending generally upwardly from one of the lateral sides, two side walls extending generally upwardly from the longitudinal sides, a shell cover comprising an outer surface and conforming generally to the shell assembly, and a removable positioner insert disposed atop the base panel and comprising first and second barriers attached to an insert base and separated by a distance selected to accommodate the width of the infant placed between the barriers to inhibit lateral motion of the infant.

According to another aspect, a device for stabilizing the position of an infant features a shell assembly including a base panel having two longitudinal sides and two lateral sides, an end wall extending generally upwardly from one of the lateral sides, two side walls extending generally upwardly from the longitudinal sides, a shell cover comprising an outer surface and conforming generally to the shell assembly, and a positioner insert disposed atop the base panel and comprising first and second barriers attached to an insert base and separated by a distance selected to accommodate the width of the infant placed between the barriers to inhibit lateral motion of the infant. One of the barriers is removably attached to the insert base to permit adjustment of the width between the first and second barriers.

According to still another aspect, a method of stabilizing the position of an infant includes providing a device having a shell assembly which includes a base panel including two longitudinal sides and two lateral sides, an end wall extending generally upwardly from one of the lateral sides, two side walls extending generally upwardly from the longitudinal sides, a shell cover comprising an outer surface and conforming generally to the shell assembly, and a positioner insert disposed atop the base panel and comprising first and second barriers attached to an insert base, adjusting a distance between the first and second barriers of the positioner insert along the insert base to accommodate the width of the infant to be placed between the barriers, placing the positioner insert on the base panel, and placing the infant between the barriers of the positioner, such that the barriers inhibit lateral motion of the infant.

In various embodiments, the removable positioner insert may permit adjustment of the distance between the first and second barriers. The insert base of the positioner may include overlapping and releasably attached first and second extension tabs with the first extension tab extending from the first barrier and the second extension tab extending from the second barrier. The barriers can have various shapes including cylindrical or polygonal. The barriers can include substantially open ends to permit airflow through the barriers. In some embodiments, the open ends of the barriers include an air-permeable covering. The barriers can be soft for increased comfort for the infant. The device may also include a pad configured to fit against the end wall and the side walls and extends beyond the base panel of the shell assembly. The pad can be configured to fit over the shell cover. One or both of the two side walls may be attached to the end wall. The device can further include a night light integrally molded to the shell assembly.

In some embodiments, at least one of the end and side walls of the shell assembly includes a plurality of standoffs extending into the shell assembly and defining recesses between the standoffs and the shell cover includes an air-permeable section overlaying the recesses to enable pneumatic communication between an outer and inner surface of the cover. The recesses may further includes apertures to improve pneumatic communication between an outer and inner surface of the cover. The device may also feature a foam foot stop removably attached to a lower portion of the base panel. Left and right side netting walls may extend from the basin to the foot stop along both sides of the base panel for providing supplemental security to the infant occupant.

In some embodiments, the device is adapted to be foldable into a stowed state and may also include a storage flap depending from a side of the base panel and releasably attached to a bottom surface of the base panel. The storage flap may be unfurled and extended over the shell assembly in the stowed state.

In some embodiments, the invention includes an adjustable positioning insert disposed within the sleep space and including two resilient members removably connected by an adjustable planar base, the planar base sized and dimensioned to span the width of the sleep space.

Accordingly, the above-described infant sleep positioner can provide a secure "sleep space" for infants on an adult bed for proximity to parents for access, feeding and care giving throughout the night. The air passages and recesses can enhance breathability and comfort, while the positioning flap can help to anchor the basin against movement.

The details of one or more embodiments of the invention are set forth in the accompanying drawings and the description below. Other features, objects, and advantages of the invention will be apparent from the description and drawings, and from the claims.

DESCRIPTION OF DRAWINGS

The invention is pointed out with particular reference in the appended claims. A fuller understanding of the natures and objects of the invention may be had be reference to the following illustrative descriptions and figures, when taken in conjunction with the accompanying claims.

Like reference symbols in the various drawings indicate like elements.

DETAILED DESCRIPTION

Figure 1:
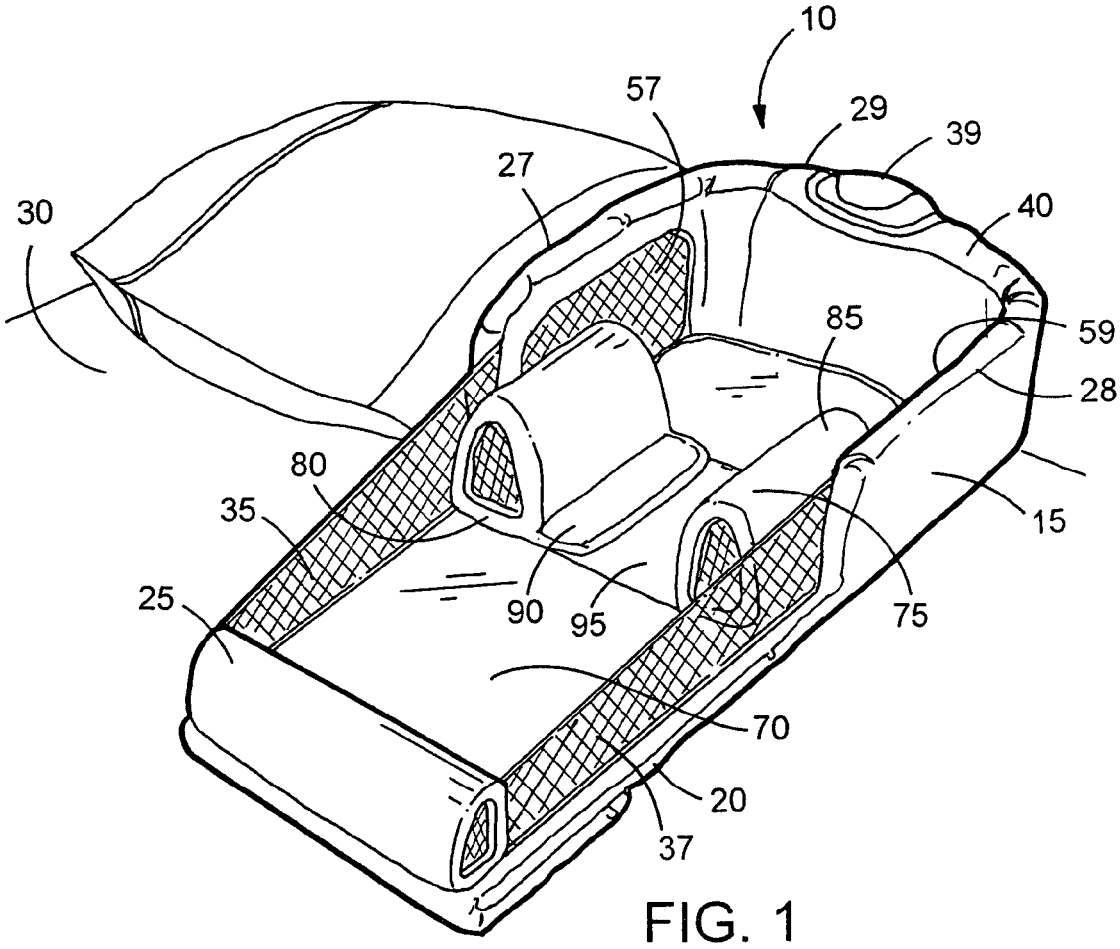
FIG. 1 is a perspective view of a infant sleep positioner, in an open position, according to the invention.

As shown in FIG. 1, the infant sleep positioner 10 generally includes a shell assembly 15, a base 20, and a foot stop 25. In one embodiment, the shell assembly 15 is a three-sided basin defining an opening and including a left wall 27, a right wall 28, and a back wall 29, each wall extending upwardly in a substantially vertical orientation. The positioner 10 is configured for placement and retention on a bed 30.

Figure 6:
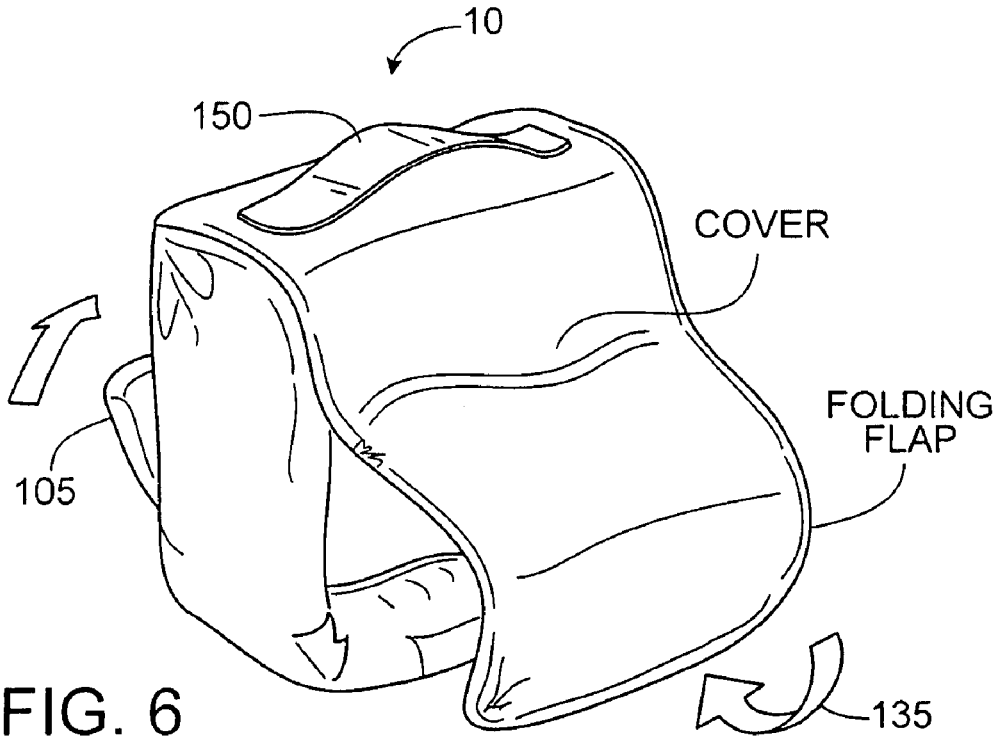
FIG. 6 is a perspective view of the infant sleep positioner of FIG. 1 in a stowed state.

In one embodiment, left and right side netting walls 35, 37 extend along the base 20 from the left and right walls 27, 28 of the shell assembly 15 to the foot stop 25. The netting walls 35, 37 can include an elastic cord threaded along the top seam of the mesh to keep the walls 35, 37 taught while permitting some deformation when a load is applied as well as folding the positioner 10 in a stowed state (FIG. 6). The walls 27, 28, 29 of the shell assembly 15, the left and right side netting walls 35, 37 and the foot stop 25 generally define the perimeter of a rectangular sleep space for the placement and protection of an infant 38. In one embodiment, the infant sleep positioner 10 includes a night light 39, including a battery holder, switch, bulb and lens, integrally mounted to a top portion of the back wall 29 of the shell assembly 15.

Figure 2:
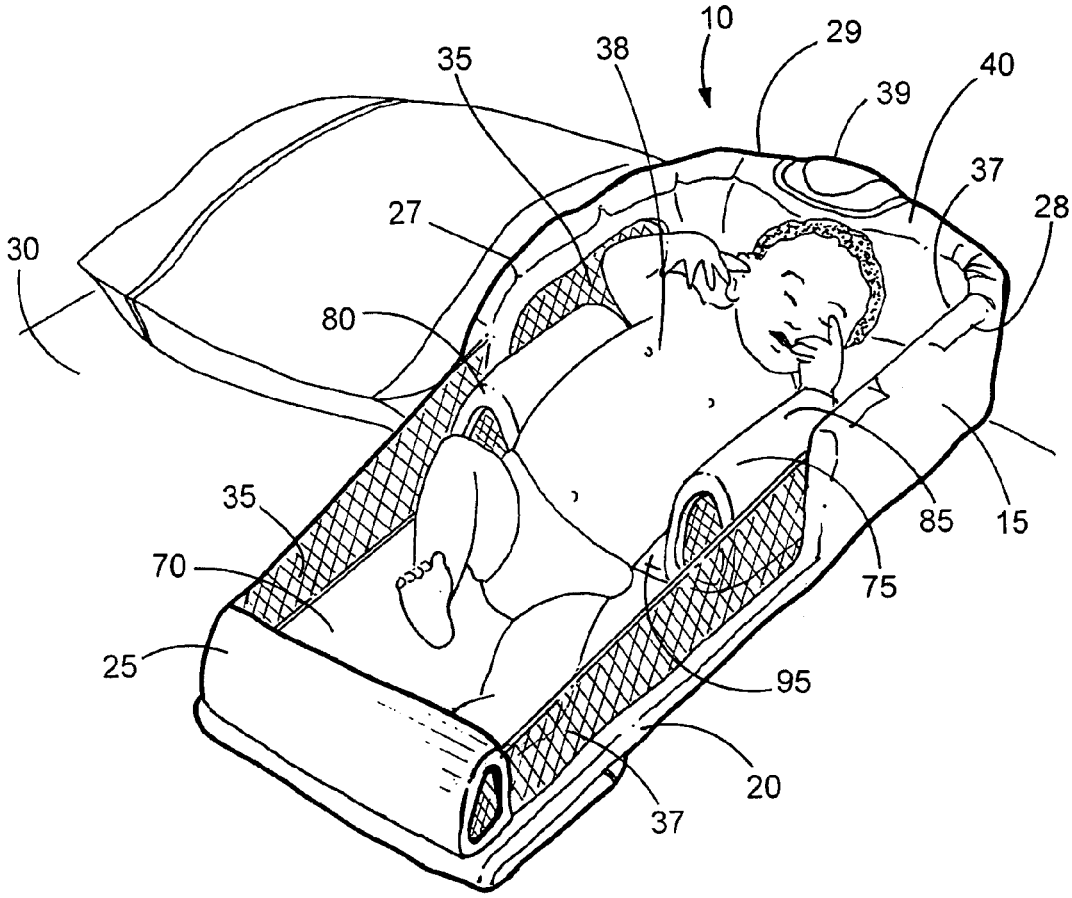
FIG. 2 is a perspective view of the infant sleep positioner of FIG. 1, holding an infant.

As shown in FIG. 2, the infant sleep positioner 10 is positioned on the bed 30 and an infant 38 is placed within the sleep space in a supine position within the sleep space of the infant sleep positioner 10.

Figure 3:
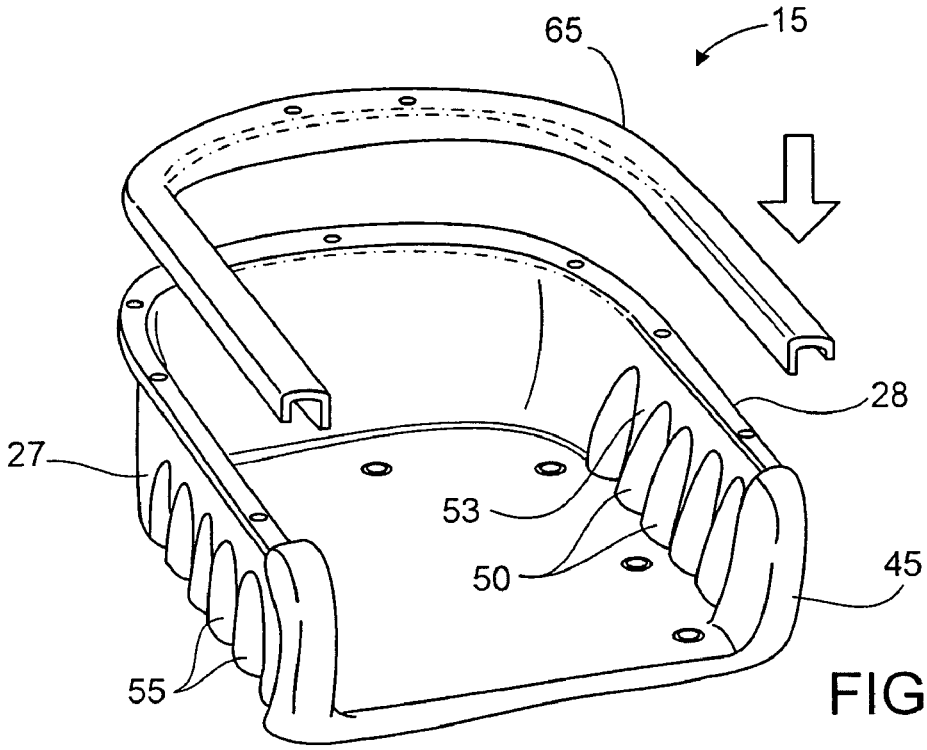
FIG. 3 is a partially exploded view of various components of the infant sleep positioner of FIG. 1.

Referring now to FIGS. 1 and 3, the shell assembly 15 includes a fabric layer 40 covering a basin core 45. Between the fabric layer 40 and the basin core 45, a layer of batting material (not shown) may be provided to impart softness to the infant sleep positioner 10. In one embodiment, the basin core 45 is formed from polypropylene and the fabric covering is polyester or a polyester blend. A portion of the basin core 45 includes a plurality of ridges or standoffs 50 and a plurality of recess regions 53 between the ridges 50. In one embodiment, a plurality of apertures 55 are located within the recess regions 53 to permit airflow through left and right walls 27, 28 of the shell assembly 15. In an embodiment, the mesh side walls 57, 59 (FIG. 1) overlay the ridges 50 to inhibit the infant 38 from contacting the recessed regions 53 between the ridges 50 and affecting normal breathing.

Preferably, as shown in FIG. 3, a top rim 65 steps the mesh side walls 57, 59 away from the standoffs 50 of the left and right shell walls 27, 28 to define a plurality of interstitial spaces 60. If the infant 38 should roll over and position his or her face proximate to the left or right side walls 27, 28, mesh side walls 57, 59 prevent the infant 38 from covering the apertures 55 and the air flow to the infant and the sleep space is not compromised. A removable mattress 70 is provided in one embodiment to fit within the sleep space and provide additional comfort to infant 39 (FIG. 2).

In one embodiment, a positioner insert 75 is removably located within the sleep space to provide additional stability to the infant 38 occupant. The insert 75 includes left and right barriers 80, 85 each having an extension tab 90, 95 extending horizontally therefrom. The extension tabs 90, 95 are removably attached together to define a desirable distance between the barriers 80, 85 generally corresponding to the width of the infant. In one embodiment, the barriers 80, 85 are hollow cylindrical or polygonal elements and include extension tabs 90, 95 at both ends of the barriers to permit airflow therethrough.

Figure 4:
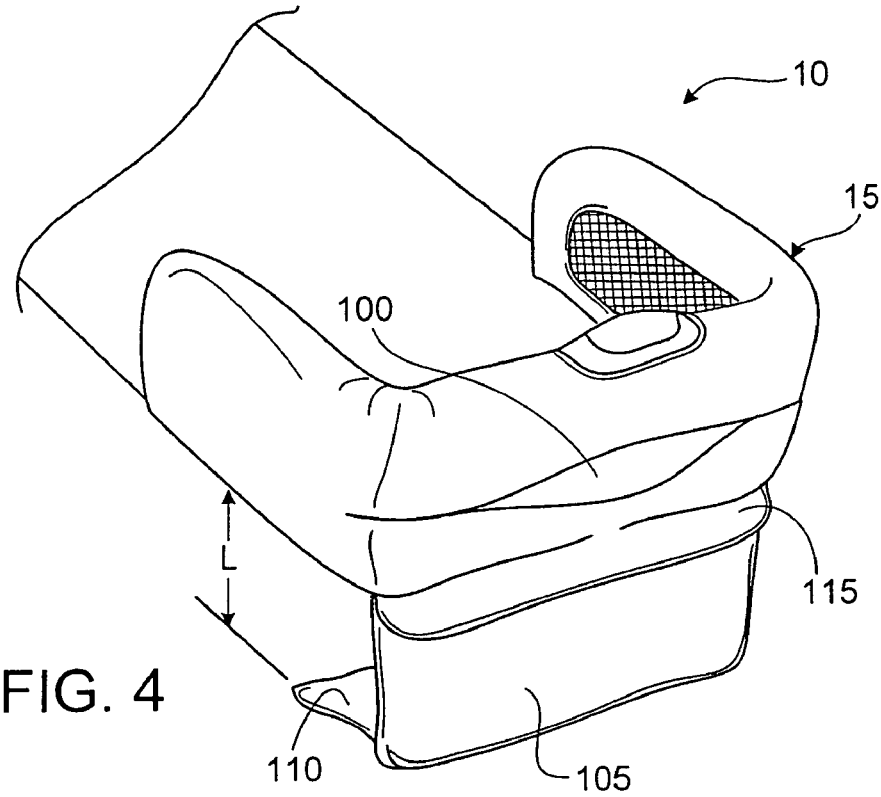
FIG. 4 is a rear perspective view of the infant sleep positioner of FIG. 1.

Referring now to the embodiment of FIG. 4, the fabric layer 40 contains a zippered opening 100 in the back of the infant sleep positioner 10 for receiving the basin core 45. An anchoring flap 105 is shown flexibly attached to a lower portion of the rear wall 29. In further embodiments, an anchoring extension 110 is flexibly attached to the anchoring extension 105. In one embodiment, the anchoring flap 105 is removably attached to the rear wall 29 at a tab 115 with hook and loop type fasteners to permit the adjustment of length L to accommodate mattresses 30 of varying heights as will be described below. Either the anchoring flap 105 or the anchoring extension 110 may include a masonite panel for additional rigidity.

Figure 5:
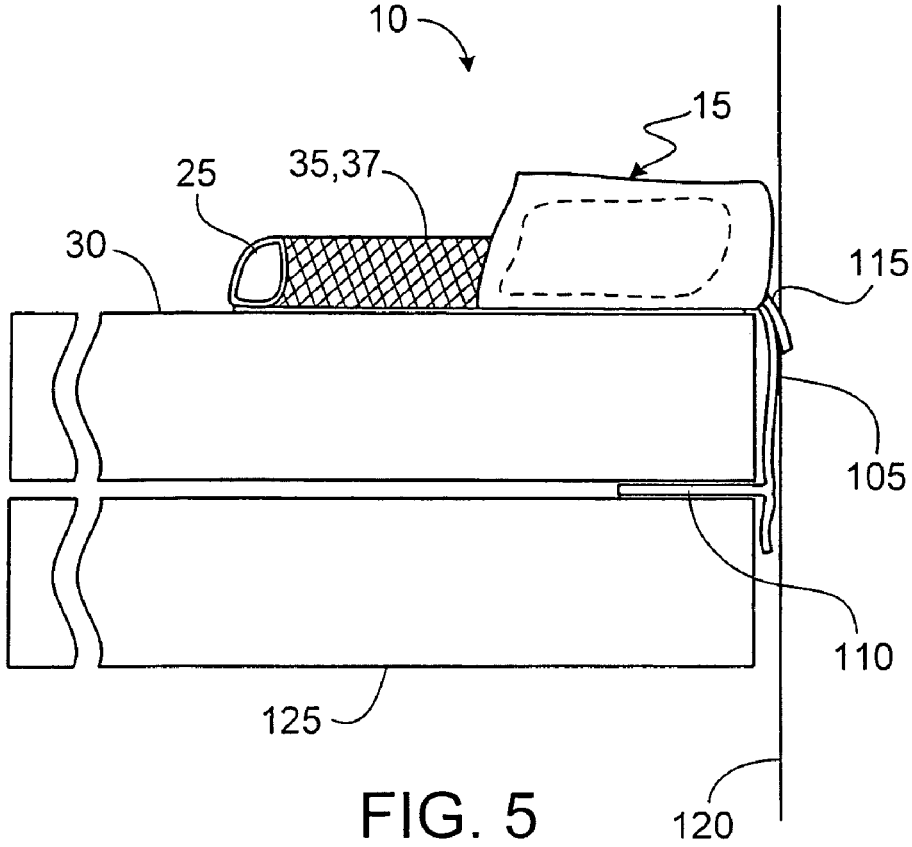
FIG. 5 is a side view of the infant sleep positioner of FIG. 1 installed on a bed.

Referring now to the embodiment of FIG. 5, the infant sleep positioner 10 is installed atop a mattress 30 with the anchoring flap 105 positioned between the mattress 30 and a wall, headboard or footboard 120 and the anchoring extension 110 is positioned between the mattress 30 and a foundation 125. In one embodiment, the length of the anchoring flap 105 is adjusted by disengaging the hook and loop fasteners holding the flap 105 to the tab 115 and reapplying the anchoring flap 105 to the tab 115 such that the anchoring extension 110 extends to the gap between the mattress 30 and the foundation 125. Tucking the anchoring extension 110 between the mattress 30 and foundation 125 and/or securing the anchoring flap 105 securely between the mattress 30 and the wall, headboard or footboard 120 minimizes lateral movement of the infant sleep positioner 10 when positioned on the bed.

Referring now to FIG. 6, the infant sleep positioner 10 is folded into a stowed state for storage or transport. After removing or moving the positioner insert 75 to the shell assembly 15, the base 20 is rolled over the top of the shell assembly 15 and a folding flap 130 is rolled up for releaseable attachment to the back of the rear wall 29 in the direction of arrow 135. The anchoring flap 105 is folded toward the bottom of the shell assembly 15 for releaseable attachment thereto with hook and loop fasteners, for example. A handle 150 is provided in one embodiment for carrying.

A number of embodiments of the invention have been described. Nevertheless, it will be understood that various modifications may be made without departing from the spirit and scope of the invention. For example, the shell assembly 15 may be configured in a tapered or frusto-conical shape, such that the left and right walls 27, 28 converge at an upper portion and the need for the rear wall 29 is obviated. Accordingly, other embodiments are within the scope of the following claims.

What is claimed is:

1. A device for stabilizing the position of an infant, the device comprising:

a shell assembly comprising, a base panel including a first longitudinal side, a second longitudinal side, a first lateral side, and a second lateral side;

an end wall extending generally upwardly from the first lateral side;

two side walls extending generally upwardly from the first and second longitudinal sides;

a shell cover comprising a flexible bottom panel substantially covering the base panel of the shell assembly and extending beyond the second lateral side of the base panel of the shell assembly, a portion of the flexible bottom panel adapted to fold over the shell assembly, a pocket adapted to receive the shell assembly and substantially enclose at least the end wall and the two side walls, the shell cover conforming generally to the shell assembly, and a portion of the shell cover including a plurality of openings; and a removable positioner insert disposed atop the base panel and comprising first and second barriers attached to an insert base and separated by a distance selected to accommodate the width of an infant placed between the barriers, to inhibit lateral motion of the infant.

2. The device of claim 1 wherein the barriers permit adjustment of the distance between the first and second barriers.

3. The device of claim 1 wherein the insert base of the positioner comprises overlapping and releasably attached first and second extension tabs, wherein the first extension tab extends from the second barrier and the second extension tab extends from the right barrier.

4. The device of claim 1 wherein the barriers are substantially cylindrical.

5. The device of claim 1 wherein the barriers are substantially polygonal.

6. The device of claim 1 further comprising a pad configured to fit against the end wall and the side walls and extending beyond the base panel of the shell assembly.

7. The device of claim 6 wherein the pad fits over the shell cover.

8. The device of claim 1 wherein the barriers comprise substantially open ends to permit airflow therethrough.

9. The device of claim 1 wherein the barriers are soft.

10. The device of claim 1 wherein at least one of the two side walls are attached to the end wall.

11. The device of claim 1 further comprising a night light integrally molded to the shell assembly.

12. The device of claim 1 wherein at least one of the end and side walls of the shell assembly comprises a plurality of standoffs extending into the shell assembly and defining recesses therebetween, the shell cover having an air-permeable section overlaying the recesses to enable pneumatic communication between an outer and inner surface of the cover.

13. The device of claim 12 wherein the recesses further comprise apertures to improve pneumatic communication between an outer and inner surface of the cover.

14. The device of claim 1 further comprising a foam foot stop removably attached to a lower portion of the base panel.

15. The device of claim 14 further comprising left and right side netting walls extending from the shell assembly to the foot stop along both sides of the base panel.

16. The device of claim 1 where the device is adapted to be foldable into a stowed state.

17. The device of claim 16 further comprising a storage flap depending from a side of the base panel and releaseably attached to a bottom surface thereof, wherein the storage flap is folded over the shell assembly in the stowed state.

18. A device for stabilizing the position of an infant, the device comprising:

a shell assembly comprising, a base panel including two longitudinal sides and two lateral sides;

an end wall extending generally upwardly from one of the lateral sides;

two side walls extending generally upwardly from the longitudinal sides;

a shell cover comprising a pocket adapted to receive the shell assembly, the shell cover including a bottom panel positioned adjacent the end wall and extending beyond the lateral side opposite the end wall, a portion of the bottom panel adapted to fold over onto a portion of the two side walls and end wall; and a removable positioner insert disposed atop the base panel and comprising first and second barriers attached to an insert base and separated by a distance selected to accommodate the width of an infant placed between the barriers, to inhibit lateral motion of the infant; and wherein the barriers comprise substantially open ends to permit airflow therethrough; and wherein the open ends comprise an air-permeable covering.

19. A device for stabilizing the position of an infant while sleeping, the device comprising:

a base panel including two longitudinal sides and two lateral sides;

an end wall extending generally upwardly from one of the lateral sides;

two side walls extending generally upwardly from the longitudinal sides;

a shell cover substantially enclosing at least the end wall and the two side walls, the shell cover conforming generally to the shell assembly, and a portion of the shell cover including a plurality of openings, the shell cover including a bottom panel positioned adjacent the end wall and extend beyond the lateral side opposite the end wall, a portion of the bottom panel adapted to fold over onto a portion of the two side walls and end wall; and a positioner insert disposed atop the base panel and comprising first and second barriers attached to an insert base and separated by a distance selected to accommodate the width of the infant placed between the barriers to inhibit lateral motion of the infant;

wherein one of the barriers is removably attached to the insert base to permit adjustment of the distance between the first and second barriers.

20. A method of stabilizing the position of an infant, the method comprising:

providing a device comprising a shell assembly including a base panel including two longitudinal sides and two lateral sides, an end wall extending generally upwardly from one of the lateral sides, two side walls extending generally upwardly from the longitudinal sides, a shell cover substantially enclosing at least the end wall and the two side walls, the shell cover conforming generally to the shell assembly, and a portion of the shell cover adjacent to one of the end wall and the two side walls including a plurality of openings, the shell cover including a bottom panel positioned adjacent the end wall and extending beyond the lateral side opposite the end wall, a portion of the bottom panel adapted to fold over onto a portion of the two side walls and end wall, and a positioner insert disposed atop the base panel and comprising first and second barriers attached to an insert base;

wherein the first and second barriers of the positioner insert are configured to enable adjustment of a distance along the insert base to accommodate the width of the infant;

wherein the positioner insert is configured to enable placement of the positioner insert on the base panel; and wherein the first and second barriers are configured to enable placement of the infant between the barriers of the positioner, and inhibit lateral motion of the infant.

* * * * *